US006752439B1

(12) United States Patent
Lundberg et al.

(10) Patent No.: US 6,752,439 B1
(45) Date of Patent: Jun. 22, 2004

(54) SNAP ON FLAG FOR FLAG SEAL

(75) Inventors: George Albert Lundberg, Pompton Plains, NJ (US); Rui Pedro Henriques, Easton, PA (US)

(73) Assignee: E. J. Brooks Company, Livingston, NJ (US)

( * ) Notice: Subject to any disclaimer, the term of this patent is extended or adjusted under 35 U.S.C. 154(b) by 144 days.

(21) Appl. No.: 09/635,158

(22) Filed: Aug. 9, 2000

(51) Int. Cl.[7] ..... E05B 39/02

(52) U.S. Cl. ..... 292/307 A; 292/307 R; 292/325; 40/664; 40/316

(58) Field of Search ..... 292/307 A, 325, 292/307 R; 40/6, 664, 316, 299.01, 632, 665

(56) References Cited

U.S. PATENT DOCUMENTS

| | | | | | |
|---|---|---|---|---|---|
| 188,522 | A | * | 3/1877 | Livermore | 40/6 |
| 230,455 | A | * | 7/1880 | Wilcox | 40/6 |
| 4,328,978 | A | * | 5/1982 | McLaughlin | 283/7 |
| 4,506,415 | A | | 3/1985 | Swift | |
| 4,694,781 | A | * | 9/1987 | Howe et al. | 119/156 |
| 5,042,181 | A | * | 8/1991 | Fortsch | 40/316 |
| 5,183,301 | A | | 2/1993 | Lundberg, Jr. | |
| 5,241,982 | A | * | 9/1993 | Taylor | 137/384 |
| 5,315,774 | A | * | 5/1994 | Chompff | 40/316 |
| 5,337,503 | A | | 8/1994 | Goby | |
| 5,524,945 | A | | 6/1996 | Georgopoulos et al. | |
| 5,568,951 | A | * | 10/1996 | Morgan | 292/307 A |
| 5,765,885 | A | * | 6/1998 | Netto | 292/318 |
| 6,343,819 | B1 | * | 2/2002 | Shiozaki | 292/307 R |
| 6,511,108 | B1 | * | 1/2003 | Roessner et al. | 292/320 |
| 6,667,091 | B1 | * | 12/2003 | Castro Netto | 428/161 |
| 2003/0178860 | A1 | * | 9/2003 | Thomas et al. | 292/307 A |

* cited by examiner

*Primary Examiner*—John B Walsh
(74) *Attorney, Agent, or Firm*—Carella, Byrne, Bain, Gilfillan, Cecchi et al.; John G. Gilfillan, III; William Squire

(57) ABSTRACT

A prior art security seal is molded one piece thermoplastic having a flag for receiving indicia such as serial number and so on and a strap extending from the flag. A locking socket depends from the flag at the junction with the strap. One or more projections extend from the flag from a surface opposite to the socket. The flag is too small for certain implementations which require a flag for receiving large labels. A large flag capable of receiving such labels is attached to the seal via the seal flag and projection. The flag has a channel for receiving the seal flag in an axial direction parallel to the plane of the flags and an opening for receiving the one or more projections, the opening having a contour that matches that of the projection(s). Snap fit latches secure the seal at flanges thereof as the projection(s) is inserted in the opening in a direction normal to the plane of the flags. The seal flag is releasably held in two normal directions to the large flag.

21 Claims, 13 Drawing Sheets

SNAP ON FLAG FOR FLAG SEAL

CROSS REFERENCE TO RELATED APPLICATIONS

Of interest is commonly owned U.S. Pat. Nos. 5,183,301 ('301), 5,524,945 ('945), and 4,506,415 ('415). Also of interest is U.S. Pat. No. 5,337,503 ('503). All of these patents are incorporated by reference herein in their entirety.

This invention relates to flag seals, and more particularly to strap type seals comprising an elongated strap attached to a locking socket from which an indicia carrier flag extends.

Such seals are in wide use. Such seals, which may be referred to as flag seals, have an elongated strap attached to a locking socket body through which the strap passes. The strap which-may have teeth in some cases as in the '301 patent or no teeth as in the '945 patent is passed into and/or through the locking socket in the body and locked thereto in a known manner. Attached to the socket body is a flag formed of a flat sheet material typically thermoplastic molded as one piece with the remainder of the seal. The flag extends from the socket body in an opposite direction than the strap. The flag bears indicia such as the name of the manufacturer of the seal and a seal serial number. The serial number is often in the form of a bar code. The seals are used to provide evidence of tampering and are attached to articles such as postal bags or any other article or apparatus for which evidence of tampering is desired. These seals, typically one piece molded thermoplastic, may include metal locking inserts. In the '945 patent, for example, a metal locking insert is inserted in the locking cavity of the locking socket.

There is a present need for some users of these seals, e.g., postal systems in particular, to place relatively large labels bearing the above or other indicia onto the flags. However, in some cases the labels are much larger than the flags on these seals, making use of these seals difficult for these applications. There thus is a need to provide seals with flags much larger than presently available. The prior art seals are relatively inexpensive and are manufactured in large quantities. Therefore, the present inventors recognize a need for a way to utilize the presently available seals such as, for example, the seal disclosed in the aforementioned Pat. No. '301 and similar seals, rather than provide new seals with the larger flags which is undesirably more costly as it wastes the presently available inventory of seals with the small flags.

A flag element for attachment to a seal according to the present invention where the seal includes a planar sheet material first flag and a strap extending from the first flag, a socket body depending from a first surface of the first flag adjacent to the strap and forming the first flag into a third flag extending from the socket body, the first flag including outwardly extending flanges on opposite sides of the socket body, at least one contoured projection extending from a second surface of the first flag opposite the socket body, the flag element comprising a sheet material second flag having opposing planar surfaces and coupling means coupled to the second flag arranged for attaching the first flag thereto.

In a further aspect, the coupling means comprises first means secured to the second flag for securing the third flag thereto and second means secured to the second flag for gripping the flanges of the first flag.

In a further aspect, the first means comprises channel means for receiving the third flag in a first direction parallel to the second flag and the second means comprises snap fit resilient means for receiving the flanges in a second direction normal to the first direction.

In a further aspect, the second flag has an opening therethrough for receiving the contoured projection therein to preclude displacement of the third flag relative to the second flag in the axial direction.

In a further aspect, the contoured projection has a given peripheral contour, the opening having a peripheral contour that matches the given contour.

In a still further aspect, the second flag has peripheral dimensions that define an area that is at least more than double the area defined by the first flag peripheral dimensions.

In a further aspect, the first means comprises third means depending from the second flag forming a channel in the second flag extending in an axial direction parallel to the second flag for capturing the first flag between the third means and the second flag, the means forming the channel having opposite side walls depending from the second flag, the channel having open ends for receiving the first flag in the channel in the axial direction.

In a further aspect, the coupling means comprises flag receiving means depending from the second flag forming a first channel in the second flag extending in an axial direction, the channel having opposite side walls depending from the second flag, the channel having open ends for receiving the first flag in the axial direction, the second flag having an opening therethrough; the coupling means further comprising first means depending from the second flag on opposite sides of the opening in the second flag cooperating to form a second channel in the second flag extending in the axial direction aligned with the first channel, the second channel having open ends for receiving the first flag in the axial direction, the second flag having an opening therethrough for receiving the at least one contoured projection therein, the at least one contoured projection having a given peripheral contour, the opening having a peripheral contour that matches the given contour, the projection for precluding relative displacement of the third flag to the second flag in the axial direction.

In a further aspect, the second flag has opposing third and fourth surfaces, the first means comprising a member secured to the second flag in spaced relation to the third surface for capturing a first portion of the first flag between the member and third surface, the second means comprising snap fit catch means for snap receiving a second portion of the captured first flag and for releasably securing the first flag thereto.

Preferably the first means comprises capture means secured to the second flag for capturing the third flag between the second flag and capture means in a displacement of the second flag in an axial direction parallel to the plane of the second flag and the second means comprises snap fit means secured to the second flag for capturing the second flag thereto in a displacement transverse to the axial direction.

In a further aspect, the coupling means includes means arranged for releasably attaching the second flag to the first flag.

In a still further aspect, the coupling means includes third flag receiving means for receiving the third flag in a first axial direction, resilient snap catch means for snap fit securing the first flag to the second flag in a second direction normal to the first direction and an opening in the second flag for receiving the projection in the second direction for precluding axial displacement of the third flag in the first direction, the first and second flags being sufficiently relative flexible to permit engagement and release of the first flag with said catch means in said second direction while the third flag is secured to the second flag in the second direction by said third flag receiving means.

IN THE DRAWING

Figure 7:
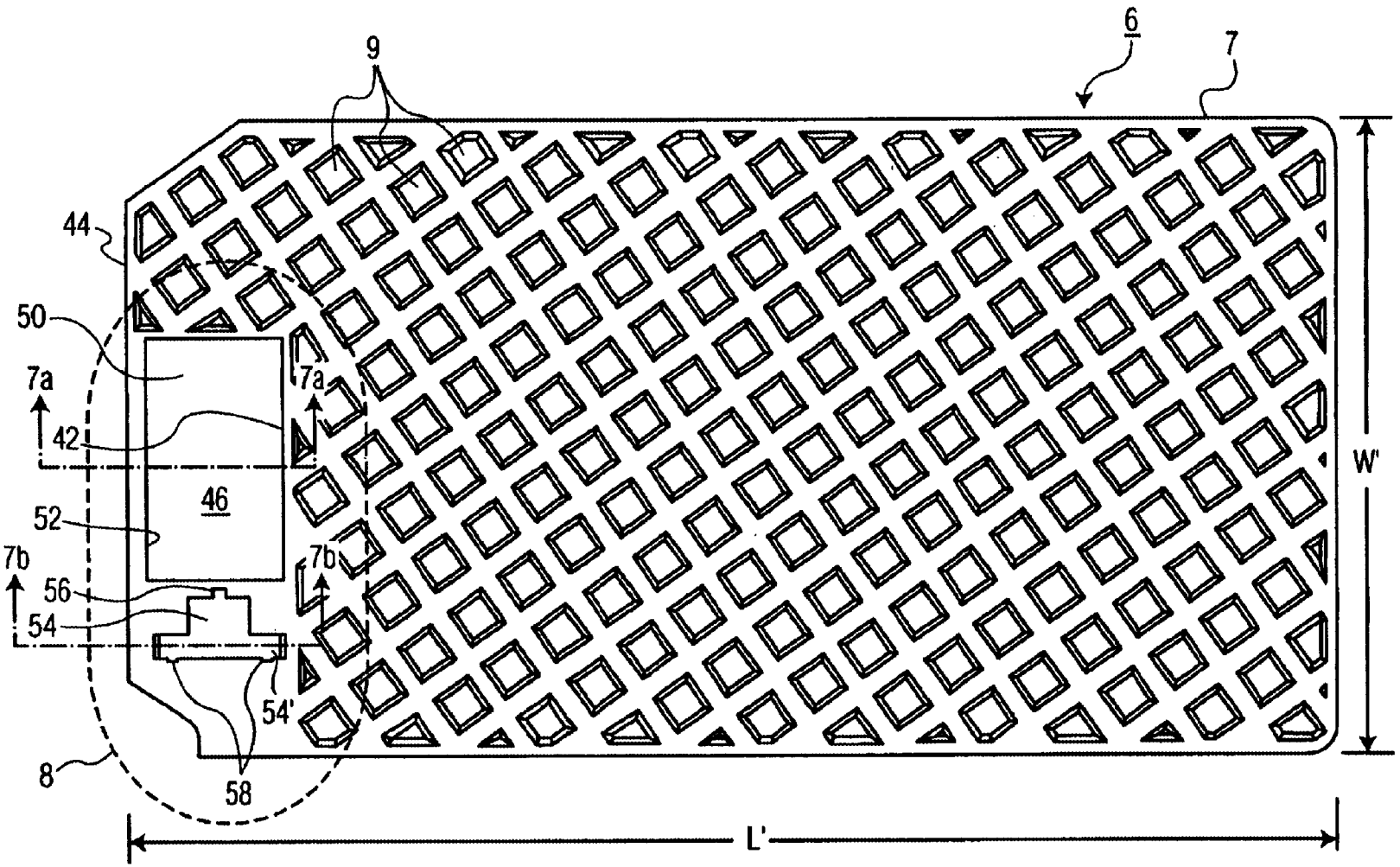
FIG. 7 is a top plan view of the flag element of FIGS. 1 and 2.
Figure 7A:
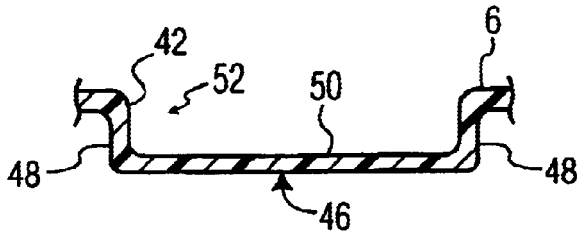

FIG. 7*a* is a sectional elevation view of the flag element of FIG. 7 taken along lines 7*a*—7*a;*

Figure 7B:
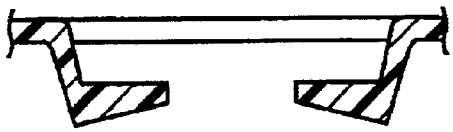

FIG. 7*b* is a sectional elevation view of the flag element of FIG. 7 taken along lines 7*b*—7*b;*

Figure 6:
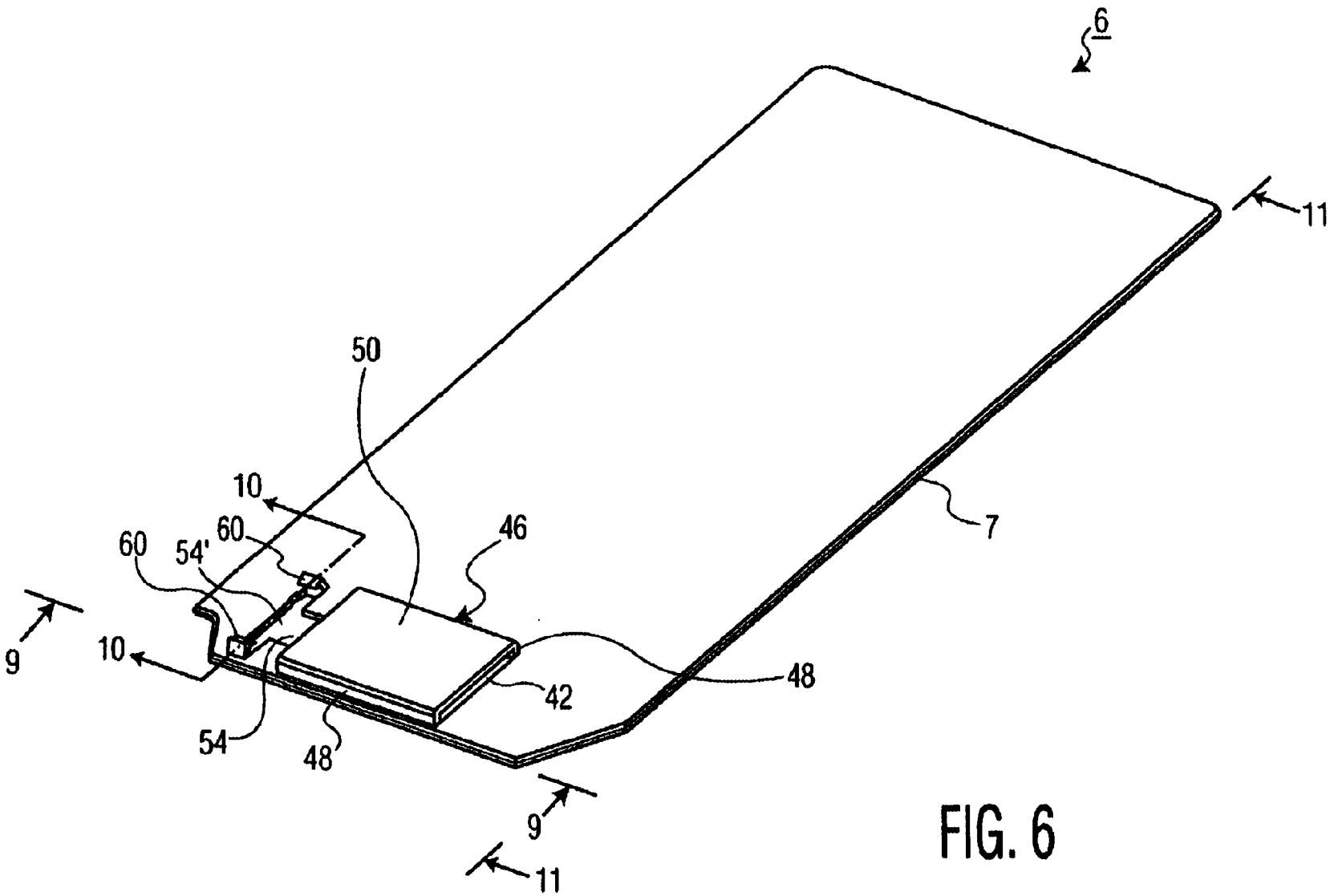
FIG. 6 is a bottom isometric view of the flag element of the embodiment of FIGS. 1 and 2.
Figure 8:
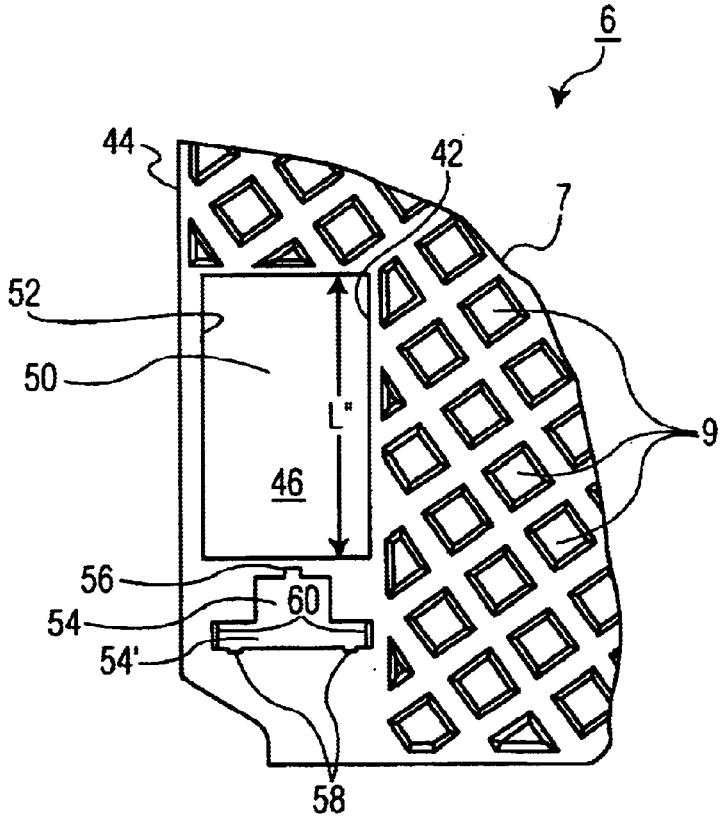
Figure 9:
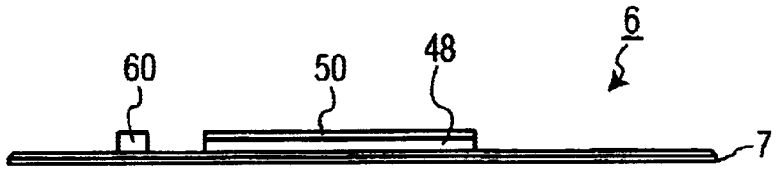
Figure 10:
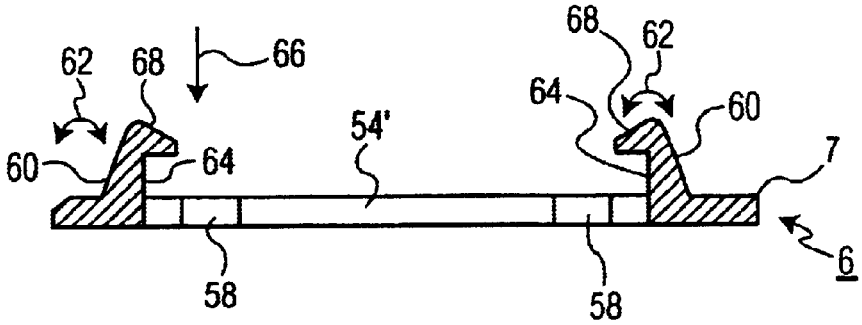
Figure 11:
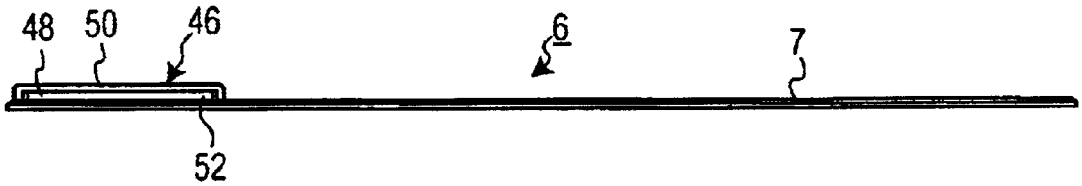
Figure 12:
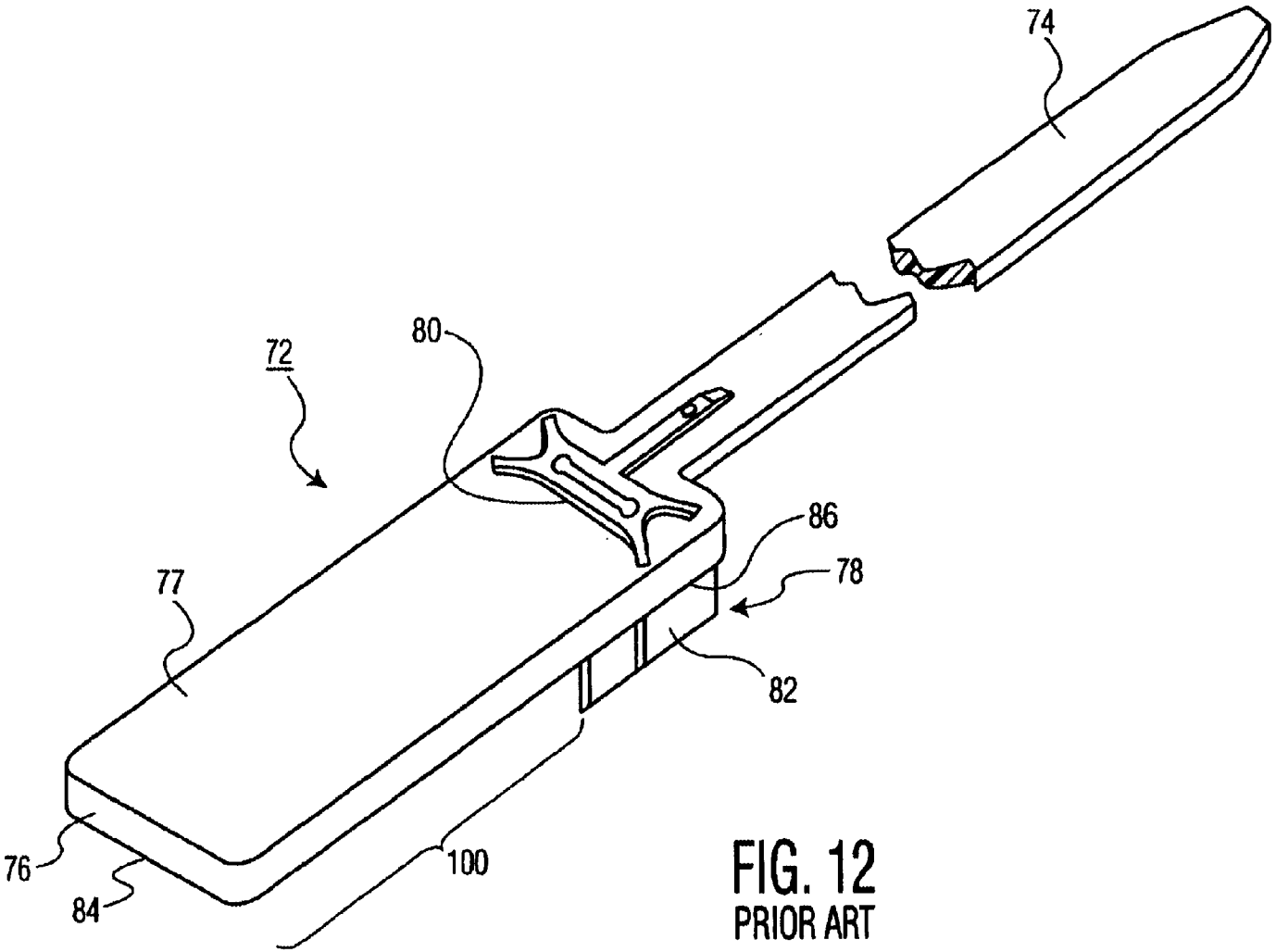
FIG. 12 PRIOR ART
Figure 13:
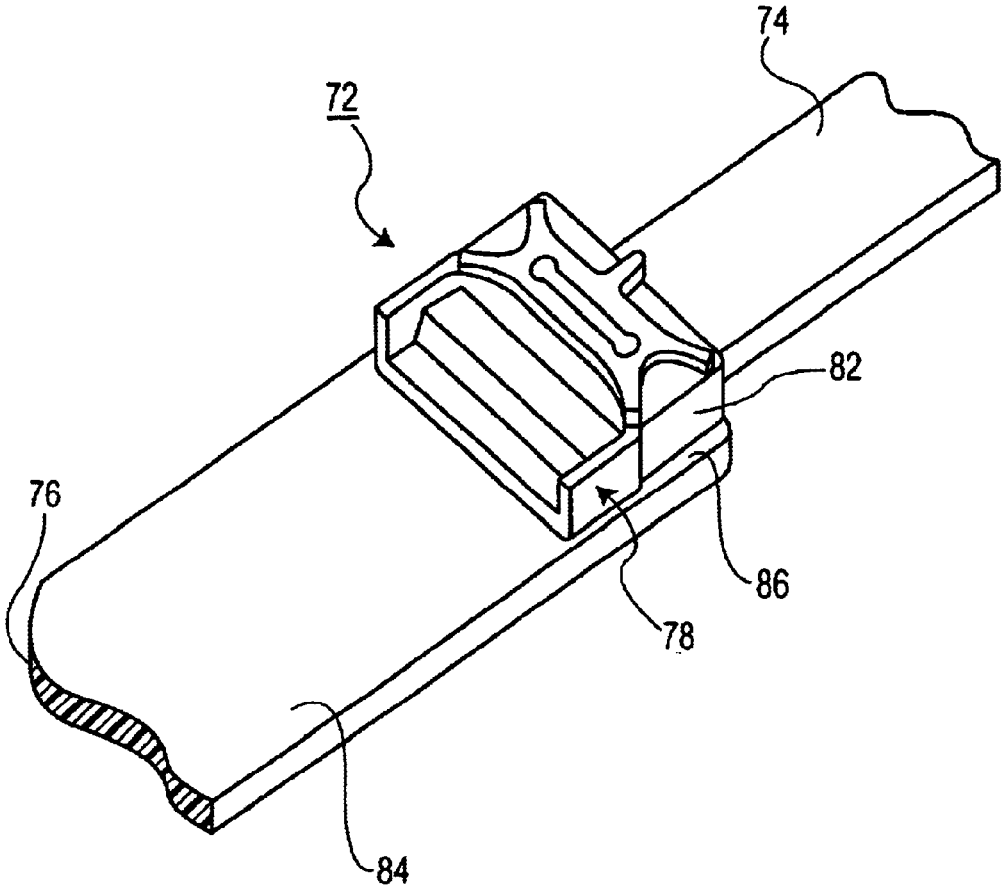
FIG. 13 PRIOR ART
Figure 14:
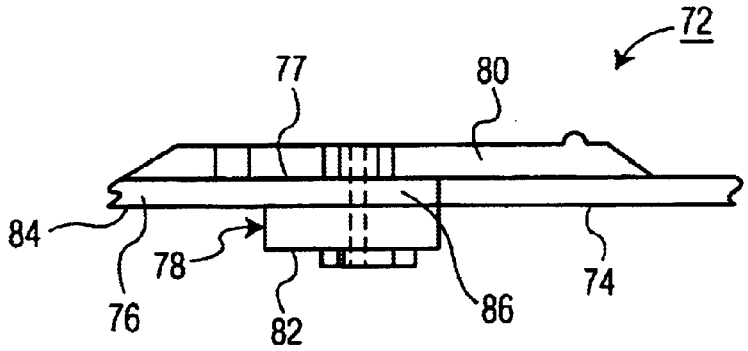
FIG. 14 PRIOR ART

FIG. 8 is a more detailed view of the seal securing portion of the flag element of FIG. 7 taken at region 8;

FIGS. 9, 10 and 11 are respective end elevation, elevation sectional, and side elevation views of an embodiment of a flag element of the present invention taken along respective lines 9—9, 10—10, and 11—11 of FIG. 6;

FIGS. 12 and 13 are respective top and bottom fragmented isometric views of a prior art seal for attachment to a flag according to a second embodiment of the present invention;

FIG. 14 is a fragmented side elevation view of the seal of FIG. 12; and

Figure 15:
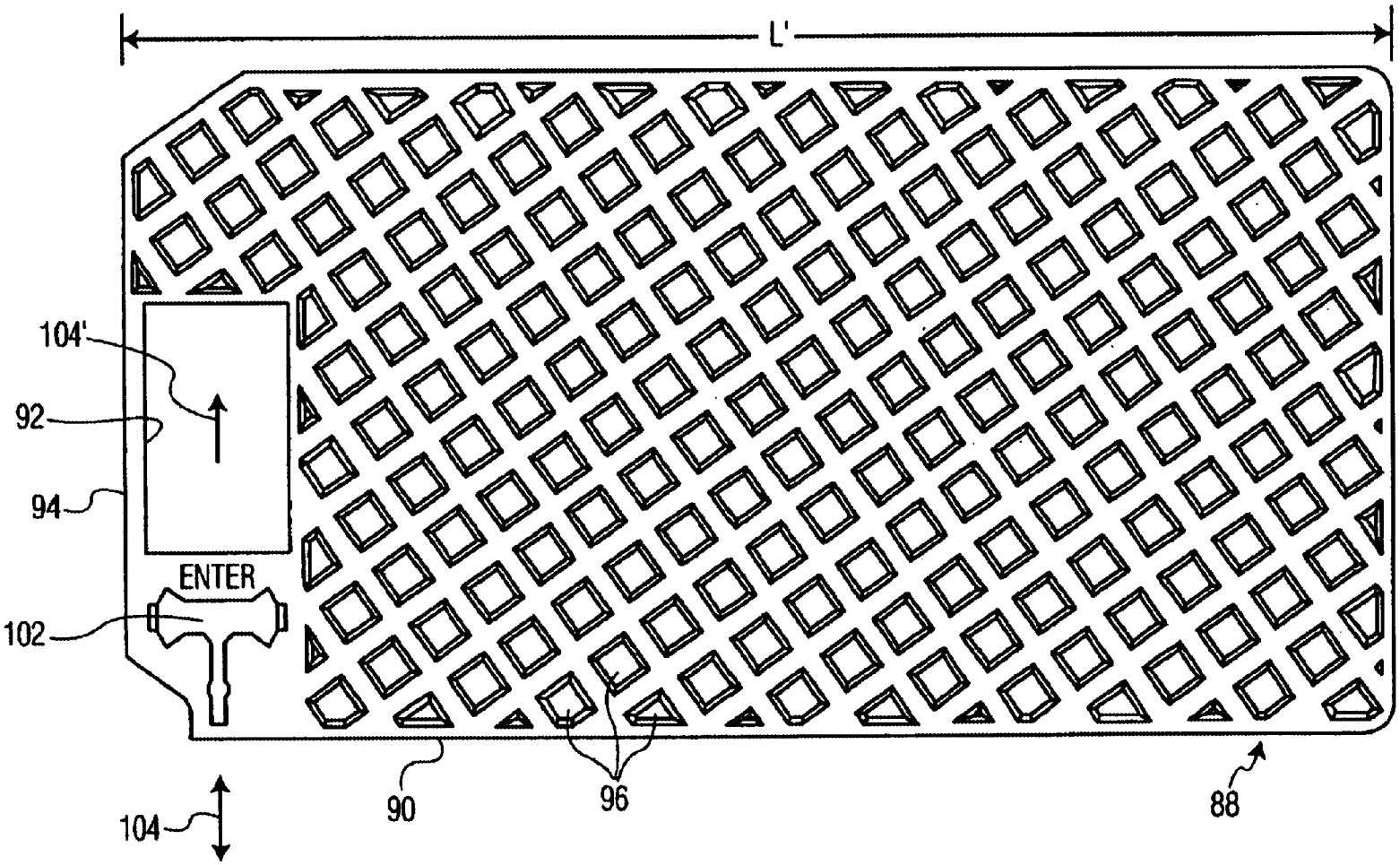
Figure 16:
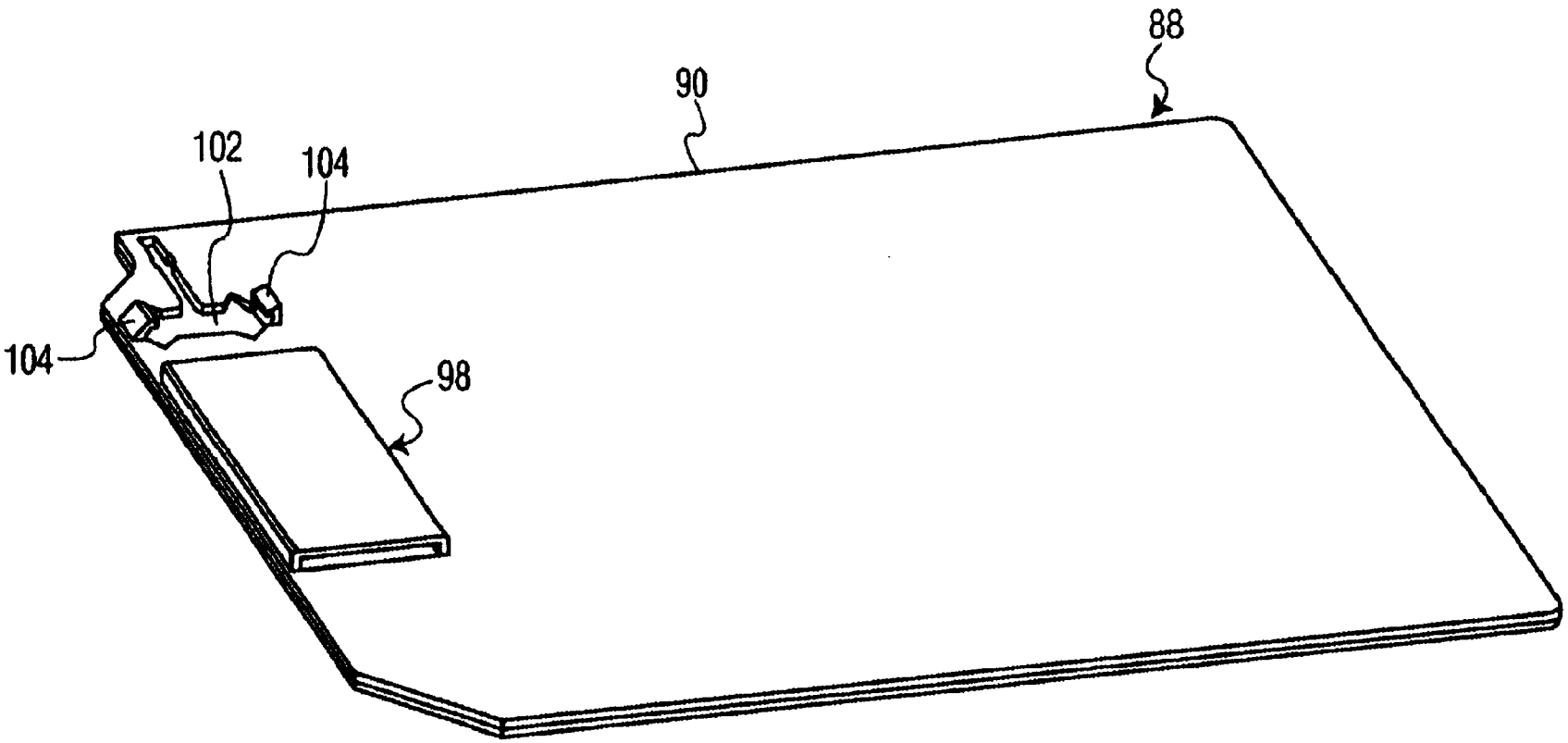

FIGS. 15 and 16 are respective top plan and bottom isometric views of a flag element according to a second embodiment of the present invention for use with the seal of FIGS. 12–14.

Figure 1:
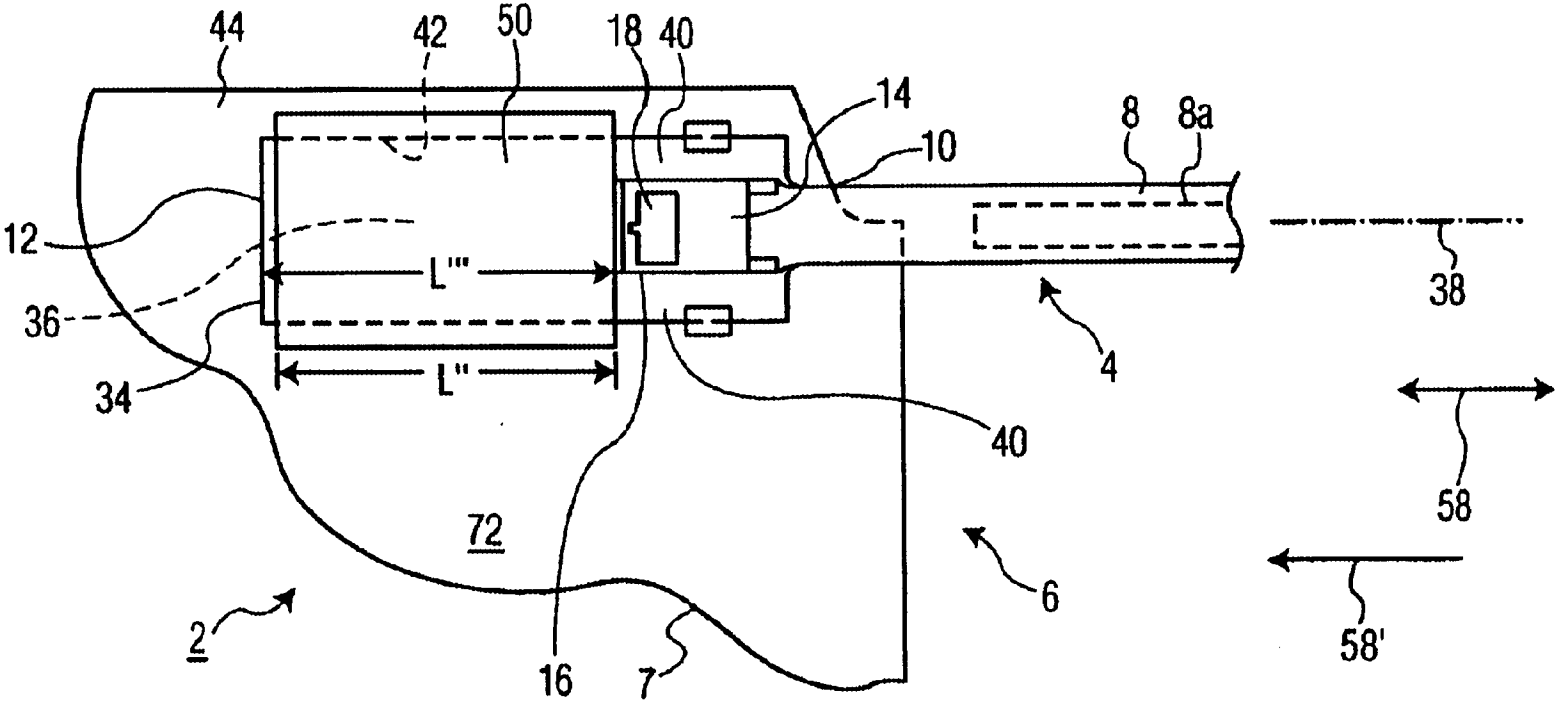
FIG. 1 is a fragmented bottom plan view of a seal attached to a flag element according to one embodiment of the present invention, the seal being described in the aforementioned '301 patent.
Figure 2:
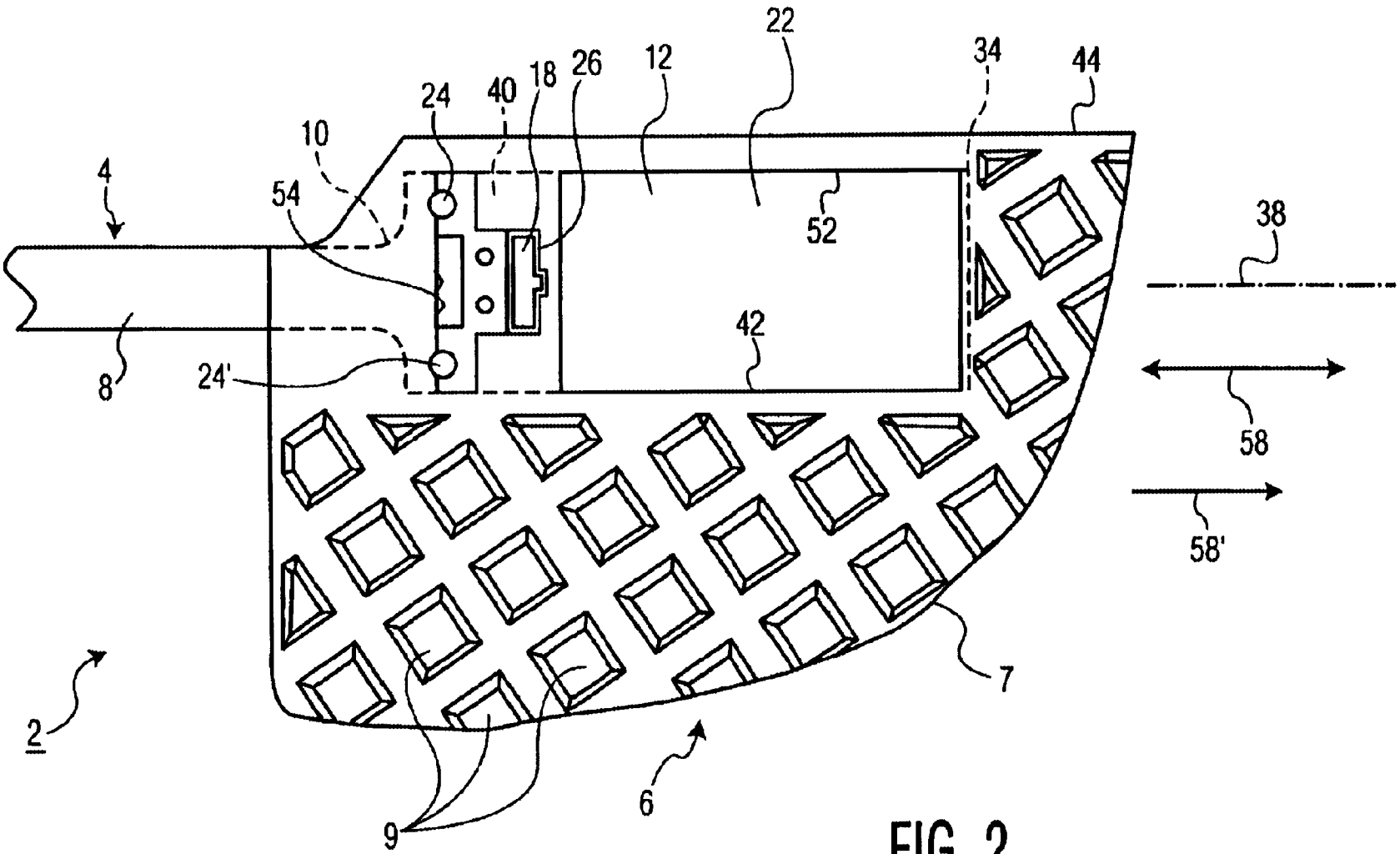
FIG. 2 is a fragmented top plan view of the seal and flag element of FIG. 1.
Figure 3:
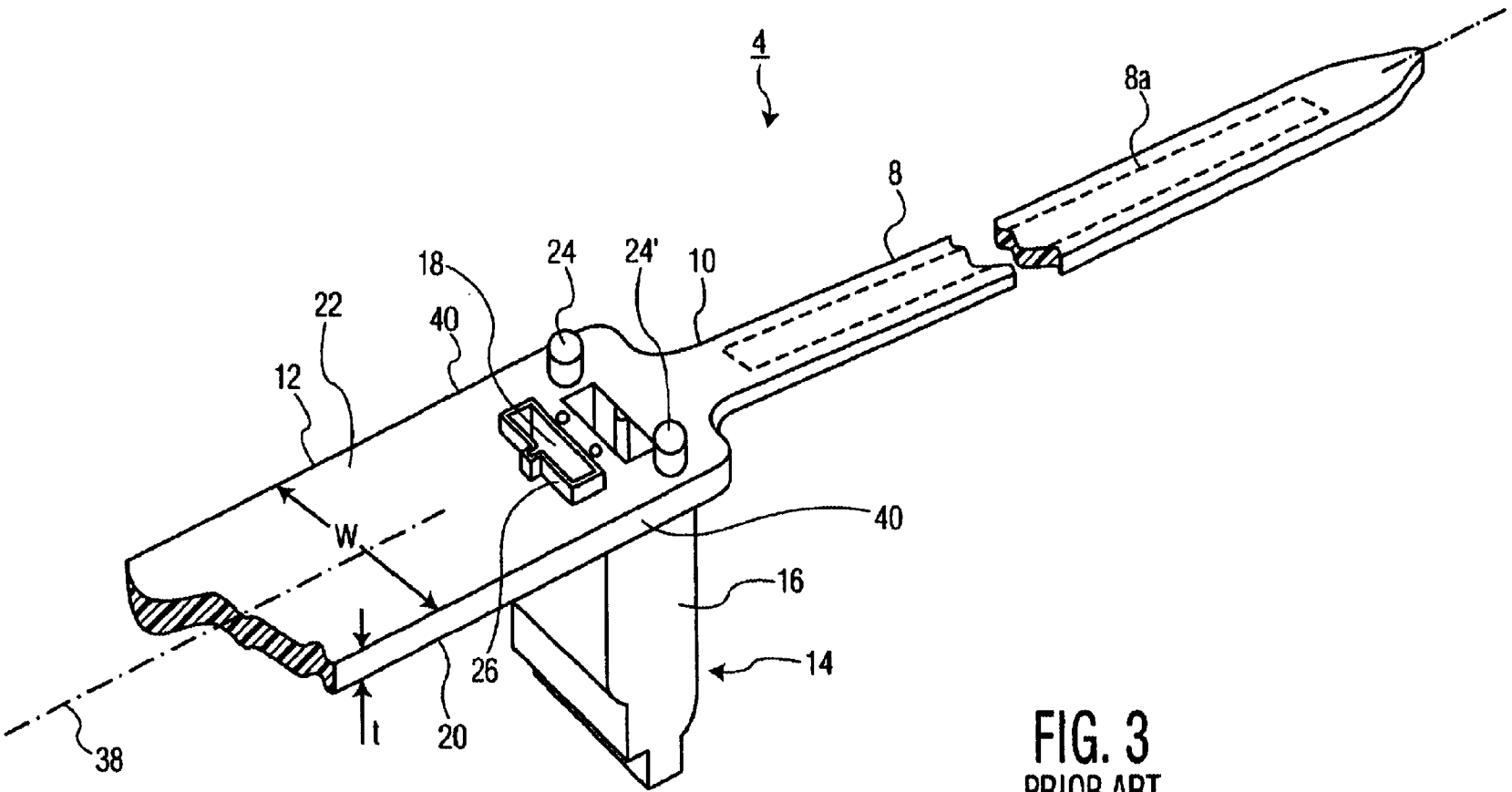
FIG. 3 PRIOR ART
FIG. 3 is a fragmented top isometric view of the seal of FIGS. 1 and 2.
Figure 4:
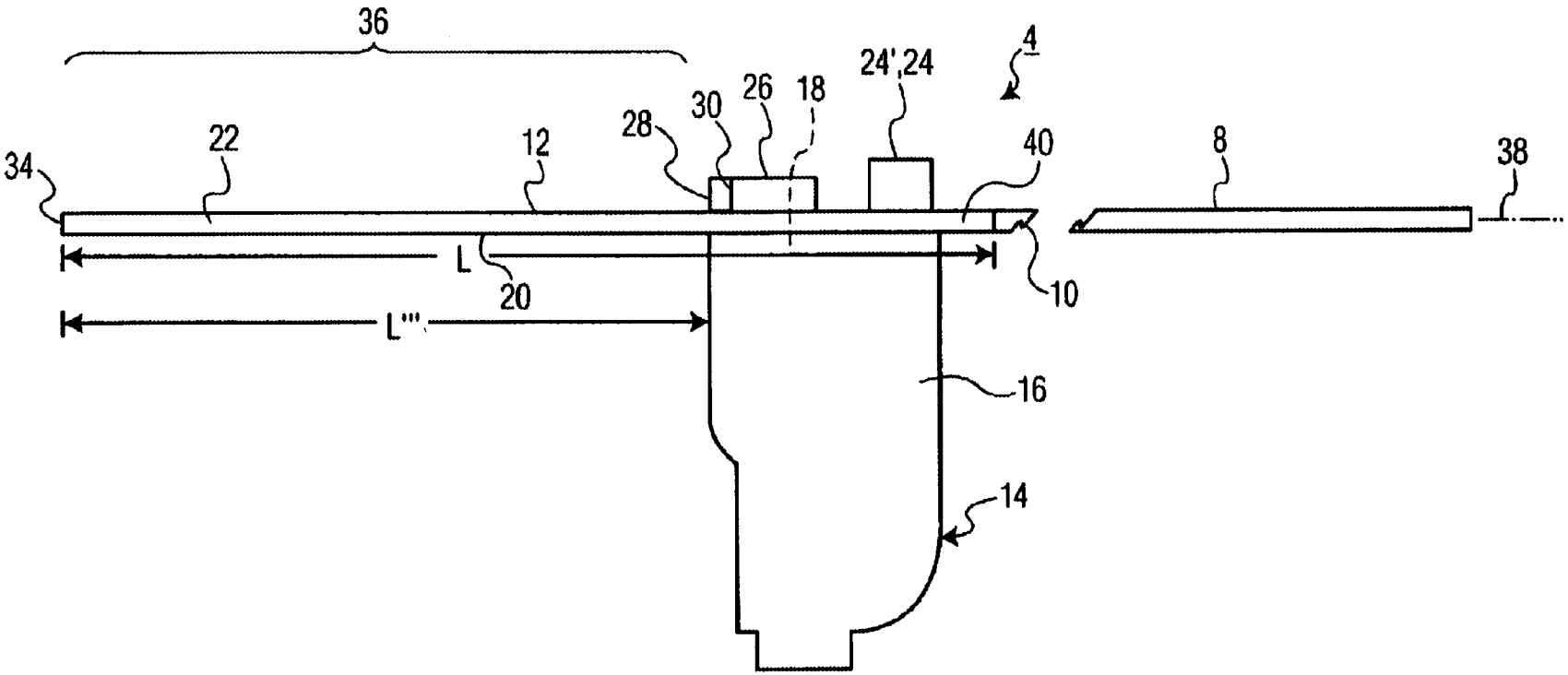
FIG. 4 PRIOR ART
FIG. 4 is a side fragmented elevation view of the seal of FIG. 3.
Figure 5:
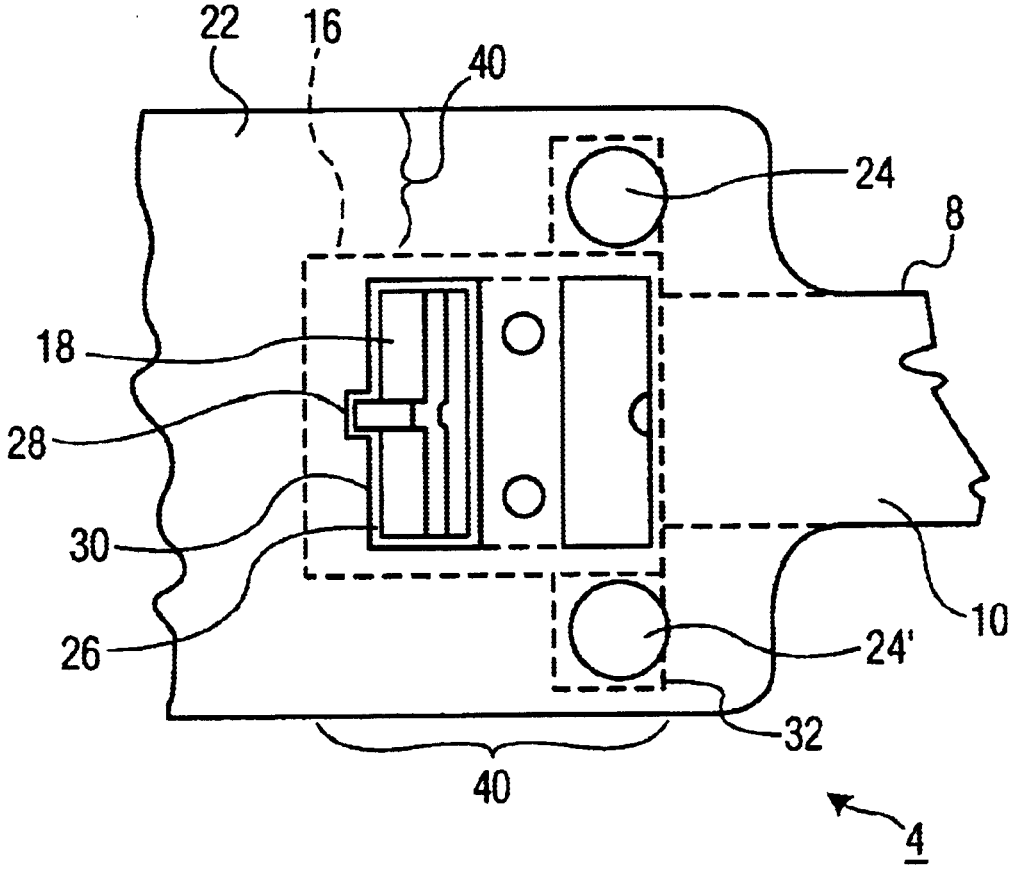
FIG. 5 PRIOR ART
FIG. 5 is a fragmented top plan view of the seal of FIGS. 3 and 4 showing the locking socket portion of the seal.

In FIGS. 1 and 2, seal assembly 2 comprises a seal 4 and a flag element 6 attached to the seal 4. In FIGS. 3, 4 and 5, the seal 4, which is described in detail in the aforementioned U.S. Pat. No. 5,183,301 incorporated by reference herein, is one piece molded thermoplastic material such as nylon or polypropylene. The seal 4 includes an elongated strap 8 which is integral and one piece at end 10 with flag 12 sometimes referred to as a tag. The strap 8 has teeth on a surface and represented by dashed line 8*a*. Other surface features are also present on the strap other surface as described in the aforementioned '361 patent and not relevant to the present invention. The strap 8 and flag 12 are relatively thin planar sheet material wherein the strap 8 in this embodiment is slightly thicker, dimension t, than the flag 12. The flag however, is wider in the width direction w than the strap 8. The flag 12 has a length L of about 5 cm and a width w of about 2.3 cm. The flag 12 is used to carry indicia such as a bar code or other form of a serial number (not shown) unique to the seal 4 and the name of the manufacturer of the seal as desired. The indicia may be embossed, printed or carried on a label secured to the flag 12.

A locking socket 14 includes a thermoplastic molded body 16 which depends from the flag surface 20 and is integral one piece molded with the flag 12 and strap 8. The socket 14 body 16 has a strap 8 receiving chamber 18 with an internal strap locking arrangement (not shown) as described in the '301 patent.

The flag 12 surface 22 opposite surface 20 has projections 24, 24' and 26 upstanding therefrom and molded one piece with the flag and strap. The projection 26 forms a collar that surrounds a portion of the chamber 18 which extends beyond the upper surface 22. The projection 22 is generally rectangular with a vertical rib 28 extending from wall 30 of the projection 22. The projections 24 and 24' are identical circular cylinders that extend from the surface 22. The projections 24, 24'and 26 together define a T-shaped peripheral contour as outlined by dashed line 32 in combination therewith, FIG. 5.

The seal 4 flag 12 portion that extends from the socket 16 body 14 to its terminal end 34 forms a flag portion 36. The edge portions of the flag 12 that extend transverse the longitudinal axis 38 from the socket 14 body 16 form flanges 40.

In FIGS. 6–8, flag element 6 comprises a sheet of relatively thin thermoplastic material, e.g., 0.050 inches (0.27 mm) thick, having a length L' of about 7.2 inches (18.3 cm) and a width w' of about 3.6 inches (9.1 cm). The flag element thus is significantly larger in area than the flag 12 of the seal 4, FIGS. 3 and 4. This larger area is to accept relatively large labels that are desired by some users of seals 4, whose flags are presently too small to accept such labels (not shown) or indicia of the magnitude associated with such labels.

The flag element 6 comprises a generally rectangular sheet 7 and has a rectangular opening 42 at end 44. Sheet 7 is thermoplastic material and is preferably formed with a large array of recesses 9 to reduce the material used to form the sheet 7. A channel member 46 is juxtaposed with opening 42. The channel member 46, FIG. 7*a*, has two side walls 48 and a bottom wall 50. The member 46 forms a channel 52 one side of which is bottom wall 50 and the other side is open formed by opening 42. The channel 52 has a length L", FIGS. 1 and 8, which is slightly smaller than the length L" of flag portion 36, FIGS. 1 and 4, of the seal 4. The width of the opening 42 is about the same as the width w of the flag 12, FIG. 3.

The flag element 6 sheet 7 has an opening 54 which is generally T-shaped with a rectangular recess 56, FIG. 8, and two space semi-circular recesses 58. The opening forms a contour that matches the contour 32 of FIG. 5. The recess 58 receives the rib 28 of the seal 4, FIG. 5, the recesses 58 receive portions of the projections 24, 24' that form part of the contour 32. The contour of the periphery of the opening thus matches the contour 32 of the projections of the seal 4, FIG. 5. The opening 54 has a contour that is sized and shaped to closely receive the projections 24, 24' and 26. When the projections are so received in opening 54, the seal can not displace in the axial directions 58 of axis 38.

In FIG. 10, the sheet 7 of flag element 6 has two resilient L-shaped latches 60. The latches can bend resiliently in directions 62 in response to a force thereon in direction 66 due to the camming inclined surface 68 of the latches 60. The latches are aligned at opposite ends of opening 54 portion 54'. The width of opening portion 54' to the interior facing surfaces 64 of the latches 60 is about the same as the width w of the seal flag 12, FIG. 3.

In operation, the flag element 6 is attached to the seal 4 by first inserting flag portion 36, FIG. 4, of the seal 4 into the channel 52 in the element 6. The flag portion 36 is flat and is parallel to the element sheet 7. End 34 of the flag portion 36 overlies the sheet 7 at an edge of the channel 32, FIGS. 1 and 2. The flag portion 36 is slid into the channel 32 in the axial direction 58'. However, the projections 24, 24' and 26 force part of the flag 12 to bend out of its plane during this insertion process. Also, the sheet 7 of the flag element at opening 54 may be bent slightly also to permit the flag 12 to be inserted into the channel 52. When so inserted, the flag 12 portion 36 is between the channel 32 bottom wall 50 in the opening 42 and the bottom surface 72 of the flag element 6 sheet 7, FIG. 1. After the flag portion 36 is fully inserted into the channel 52 of the element 6, the projections 24, 24' and 26 are then inserted into the opening 54 aligned therewith. During this insertion the flanges 40 of the seal 4 are pressed against the latches 60, FIG. 10, spreading the latches 60 apart, directions 62, so that the flag 12 of the seal 4 snaps in place between the latches 60 which then resiliently return to their quiescent position of FIG. 10. The latches 60 retain the seal in a direction normal to the plane of the sheet 7 and the projections 24, 24' and 26 prevent the flag portion 36 from easily being withdrawn from the channel 52 in the flag element 6. As a result, a significantly larger flag is readily releasably attached to the seal 4. The flag element may be detached from the seal by reversing the order of the insertion steps described above. Thus, the seal once attached to the flag element can not easily be withdrawn from the channel 52 since the seal axial movement is restrained by the engaged projections and opening 54. The seal can not easily be displaced normal to the plane of the sheet 7 due to the presence of the channel member 46 and latches 60. Force must be used to bend the various components in the reverse order of insertion in order to remove the seal from its locked engagement with the flag element 6. The seal is thus reliably held to the flag element which is easily attached to the seal providing enhanced utilization of the seal 4.

In FIGS. 12–14, a seal 72 according to a second embodiment is a molded one piece construction and comprises a strap 74, a flag 76, a locking socket 78 and a contoured projection 80. The locking socket 78 depends from the flag 76 bottom surface 84 adjacent to the junction of the strap and flag. The contoured projection 80 is generally in the shape of a complex cross and extends from the flange 76 upper surface 77. The seal 72 is generally described in U.S. Pat. No. 5,524,945 incorporated by reference herein in its entirety and is substantially the same as described therein except for the peripheral shape of the projection 80 and shape of the body 82.

These particular shapes are not important as the projection 80 can have any desired shape that meets the function of the present invention as described herein. Locking socket 78 has a body 82. The flag 76 exhibits two flanges 86 at bottom surface 84 and extending transversely from the body 82, on opposite sides of the body 82. The flag 76 may be dimensioned similarly as the flag 12 of the seal of FIG. 1.

In FIGS. 15 and 16, flag element 88 comprises a sheet of relatively thin thermoplastic material, e.g., 0.050 inches (0.27 mm) thick, having a length L' of about 7.2 inches (18.3 cm) and a width w' of about 3.6 inches (9.1 cm). The flag element 88 is significantly larger in area than the flag 76 of the seal 72, FIGS. 12–14. This larger area is to accept relatively large labels that are desired by some users of seals as described above.

The flag element 88 comprises a generally rectangular sheet 90 and has a rectangular opening 92 at end 94. Sheet 90 is thermoplastic material and is preferably formed with a large array of recesses 96 to reduce the material used to form the sheet. A channel member 98 is juxtaposed with opening 92 and is constructed similarly as channel member 46 in the embodiment of the flag element 6 of FIGS. 6–11, with two side walls and a bottom wall. The member 98 forms a channel one side of which is the bottom wall and the other side is open formed by opening 92. The channel 92 has a length which is slightly smaller than the length of flag portion 100, FIG. 12 of the seal 72. The width of the opening 92 is about the same as the width of the flag 76.

The flag element sheet 90 has an opening 102 which is generally T-shaped with a complex peripheral contour that matches the peripheral contour of the projection 80. The opening 102 has a contour that is sized and shaped to closely receive the projection 80. When the projection 80 is so received in opening 102, the seal can not displace in the axial directions 104.

In FIG. 16, the sheet 90 of flag element 88 has two resilient L-shaped latches 104. These latches are substantially identical to the latches 60, FIG. 10, and operate in a similar manner as latches 60 to hold the flag 77 of the seal 72, FIG. 12, to the flag element 88.

In operation, the flag element 88 is attached to the seal 72 by first inserting the flag 72 portion 100, FIG. 12, of the seal 72 into the channel at opening 92 in the element 88. The flag portion is flat and is parallel to the element sheet 90. End 84 of the flag portion 100 overlies the sheet 90 at an edge of the sheet channel as described in connection with the embodiment of FIGS. 1 and 2. The flag portion 100 is slid into the channel in the axial direction 104', FIG. 15. However, the projection 80 forces part of the flag 77 to bend out of its plane during this insertion process. Also, the sheet 90 of the flag element 88 at opening 102 may be bent slightly also to permit the flag 77 to be inserted into the flag element channel. When so inserted, the flag 77 portion 100 is between the channel bottom wall in the opening 92 and the bottom surface of the flag element 88 sheet 90. After the flag portion 100 is fully inserted into the channel of the element 88, the projection 80 is then inserted into the opening 102 aligned therewith. During this insertion the flanges 86 of the seal 72 are pressed against the latches 104, FIG. 14, spreading the latches 104 apart so that the flag of the seal 72 snaps in place between the latches 104. The latches 104 resiliently return to their quiescent position of FIG. 16. The latches 104 retain the seal in a direction normal to the plane of the sheet 90 and the projection 80 prevents the flag portion 100 from easily being withdrawn from the sheet channel in the flag element 88. The flag element may be detached from the seal by reversing the order of the insertion steps described above.

Thus, the seal once attached to the flag element can not easily be withdrawn from the channel since the seal axial movement is restrained by the engaged projection 80 and opening 102. The seal can not easily be displaced normal to the plane of the sheet due to the presence of the channel member and latches 104. Force must be used to bend the various components in the reverse order of insertion in order to remove the seal from its locked engagement with the flag element 6. The seal is thus reliably held to the flag element which is easily attached to the seal providing enhanced utilization of the seal.

It should be understood that the description is given by way of illustration and not limitation. While various modifications may be made to the disclosed embodiments, such variations are intended to be included in the scope of the claimed invention as defined by the appended claims. For example, the various relative orientations of the flags and their shapes may differ from that shown. Also, the coupling arrangements for securing the large flag to the smaller seal flag may also differ from that shown. For example, the flag element may have a snap fit pin molded thereto which fits in a mating opening in the mating seal flag or other structure attached to the seal for securing the large flag element to the seal. The snap fit pin may have an enlarged catch that mates with a notch in the mating opening in the mating seal flag. The contours of the mating parts of the flag element and seal may be of any desired shape for a given implementation.

What is claimed is:

1. A flag element for attachment to a seal, the seal including a planar sheet material first flag and a strap extending from the first flag or socket body as set forth as follows, a socket body depending from a first surface of the first flag adjacent to the strap, the first flag including outwardly extending flanges on opposite sides, the flag element comprising:

a sheet material second flag having opposing planar surfaces; and coupling means coupled to the second flag arranged for attaching the first flag thereto.

2. The flag element of claim 1 wherein the coupling means comprises first means secured to the second flag for gripping the flanges of the first flag.

3. The flag element of claim 1 wherein the coupling means comprises channel means for receiving the first flag in a first direction parallel to the second flag and further including snap fit resilient means for receiving the flanges in a second direction normal to the first direction.

4. The flag element of claim 3 wherein the first flag includes at least one contoured projection extending from a second surface of the first flag opposite the socket body, the second flag has an opening therethrough for receiving the at least one contoured projection therein to preclude relative displacement of the first flag to the second flag in the first direction.

5. The flag element of claim 1 wherein the first flag includes at least one contoured projection extending from a second surface of the first flag opposite the socket body, the at least one contoured projection has a given peripheral contour, the second flag having an opening for receiving the projection and having a peripheral contour that matches the given contour.

6. The flag element of claim 2 wherein the second flag has peripheral dimensions that define an area that is at least more than double the area defined by the first flag peripheral dimensions.

7. The flag element of claim 2 including second means depending from the second flag forming a channel in the second flag extending in an axial direction parallel to the second flag for capturing the first flag, the channel having opposite side walls depending from the second flag, the channel having open ends for receiving the first flag in the channel in the axial direction.

8. The flag element of claim 2 wherein the second flag has an opening therethrough, the first means comprising a pair of members depending from the second flag on opposite sides of the opening in the second flag cooperating to form a channel in the second flag extending in an axial direction, the channel having open ends for receiving the first flag in the axial direction.

9. The flag element of claim 2 including second means comprising a U-shaped channel member depending from the second flag forming a channel in the second flag extending in an axial direction parallel to the second flag, the channel having opposite side walls depending from the second flag, the U-shaped channel member having open ends for receiving the first flag in the channel in the axial direction.

10. The flag element of claim 1 wherein the second flag exhibits a plurality of recesses in a surface thereof.

11. The flag element of claim 4 wherein the at least one contoured projection comprises a plurality of projections defining a peripheral contour, the second flag opening having a peripheral contour for receiving the plurality of projections.

12. The flag element of claim 2 wherein the first means comprises resilient members forming first and second hooks resiliently attached to the second flag in spaced mirror image relationship.

13. The flag element of claim 1 wherein the first flag includes at least one contoured projection extending from a second surface of the first flag opposite the socket body, the coupling means comprising flag receiving means depending from the second flag forming a first channel in the second flag extending in an axial direction parallel to the second flag, the channel having opposite side walls depending from the second flag, the channel having open ends for receiving the flag portion in the axial direction, the second flag having an opening therethrough, the coupling means further comprising first means depending from the second flag on opposite sides of the opening in the second flag cooperating to form a second channel in the second flag extending in the axial direction aligned with the first channel, the second channel having open ends for receiving the first flag in the axial direction, the second flag having an opening therethrough for receiving the at least one contoured projection therein, the at least one contoured projection having a given peripheral contour, the opening having a peripheral contour that matches the given contour, the opening and engaged projection for precluding axial displacement of the flag portion relative to the second flag in the axial direction.

14. The flag element of claim 2 wherein the second flag has opposing third and fourth surfaces, further including second means comprising a member secured to the second flag in spaced relation to the third surface for capturing a first portion of the first flag between the member and third surface, the first means comprising snap fit catch means for snap receiving a second portion of the captured first flag and for releasably securing the first flag thereto.

15. The flag element of claim 2 further including second means comprising capture means secured to the second flag for capturing the first flag between the second flag and the capture means by displacement of the second flag in an axial direction parallel to the plane of the second flag, the first means comprising snap fit means secured to the second flag for capturing the first flag thereto in a displacement transverse to the axial direction, and complementary means coupled to the first and second flags for precluding axial relative displacement of the first and second flags to each other.

16. The flag element of claim 1 wherein the coupling means includes means arranged for releasably attaching the second flag to the first flag.

17. The flag element of claim 16 including at least one projection extending from a second surface of the first flag opposite the socket body, wherein the coupling means includes first flag receiving means for receiving the first flag in a first axial direction, resilient snap catch means for snap fit securing the first flag to the second flag in a second direction normal to the first direction and an opening in the second flag for receiving the projection in the second direction for precluding axial displacement of the first flag in the first direction, the first and second flags being sufficiently flexible to permit engagement and release of the first flag with said catch means in said second direction while the first flag is secured to the second flag in said second direction by said first flag receiving means.

18. A seal construction comprising:

a planar sheet material first flag;

a strap extending from the first flag;

a socket body depending from a first surface of the first flag adjacent to the strap;

a sheet material second flag having opposing planar surfaces; and coupling means secured to at least one of the flags for releasably attaching the second flag to the first flag.

19. The seal of claim 18 wherein the coupling means comprises a channel member secured to the second flag for receiving the first flag.

20. The seal of claim 18 wherein the coupling means comprises snap fit means attached to the second flag for snap fit securing the first flag to the second flag.

21. The seal of claim 18 including projection means extending from the first flag and an opening in the second flag for receiving the projections and for precluding relative movement of the first flag to the second flag in a direction parallel to the surfaces of said flags.

* * * * *